United States Patent [19]

Inoue et al.

[11] Patent Number: 4,993,513

[45] Date of Patent: Feb. 19, 1991

[54] MUFFLER

[75] Inventors: Takeshi Inoue; Hiroshi Funabashi, both of Saitama; Yukihiro Nakagawa, Aichi, all of Japan

[73] Assignees: Honda Giken Kogyo Kabushiki Kaisha, Tokyo; Nakagawa Sangyo Co., Ltd., Aichi, both of Japan

[21] Appl. No.: 302,531

[22] Filed: Jan. 27, 1989

[30] Foreign Application Priority Data

Jan. 29, 1988 [JP] Japan ..... 63-11070[U]
Jan. 29, 1988 [JP] Japan ..... 63-11071[U]

[51] Int. Cl.[5] ..... F01N 1/24; F01N 7/14; F01N 7/18

[52] U.S. Cl. ..... 181/282; 181/228; 181/243; 181/246; 181/252; 181/255; 181/269

[58] Field of Search ..... 181/211, 228, 243–245, 181/248, 249, 252, 255, 269, 282, 256

[56] References Cited

U.S. PATENT DOCUMENTS

| | | | |
|---|---|---|---|
| 2,841,232 | 7/1958 | Loeffler | 181/228 X |
| 3,043,097 | 7/1962 | Inman et al. | 181/262 X |
| 3,227,242 | 1/1966 | Mattoon | 181/245 |
| 3,857,458 | 12/1974 | Ohtani et al. | 181/262 |
| 4,239,091 | 12/1980 | Negrao | 181/243 |
| 4,587,516 | 5/1986 | Inoue et al. | 181/256 |
| 4,598,790 | 7/1986 | Uesugi et al. | 181/252 |

*Primary Examiner*—Benjamin R. Fuller
*Attorney, Agent, or Firm*—Armstrong, Nikaido, Marmelstein, Kubovcik & Murray

[57] ABSTRACT

A muffler includes an outer box fitted over and attached to an exhaust pipe. The muffler also has a connecting member of a noncircular cross section fixed to said exhaust pipe and interposed between the exhaust pipe and the outer box.

12 Claims, 4 Drawing Sheets

MUFFLER

BACKGROUND OF THE INVENTION

1. Field of the Invention

The present invention relates to a muffler to be coupled to the exhaust pipe of an internal combustion engine for attenuating exhaust sound.

2. Description of the Relevant Art

Generally, the exhaust system of an internal combustion engine is coupled to an exhaust muffler having an expansion chamber. Exhaust gases from the engine are introduced into the expansion chamber and allowed to expand therein for dissipate the energy of the exhaust gases to dampen the exhaust sound.

U.S. Pat. No. 4,589,516, assigned to the same assignee as the assignee of the present application, discloses a muffler comprising a tubular outer box defining an expansion chamber therein and composed of a pair of lateral separate bodies of a formed sound insulation material. A tubular exhaust pipe is inserted into the outer box and bonded thereto by an adhesive. Each of the separate bodies comprises an outer layer of synthetic resin and an inner heat insulation layer of glass wool or the like.

The outer box has a recess of circular cross section in which the exhaust pipe is fitted. When the outer box is subjected to a circumferential rotative force, such a force or moment is limited only by frictional forces between the outer box and the exhaust pipe and also by the bonding strength of the adhesive applied therebetween. Since the bonding strength is reduced with time, the outer box may eventually be caused to rotate with respect to the exhaust pipe when a moment is applied to the outer box about the exhaust pipe.

The present invention has been made to improve the conventional muffler of the type described above.

SUMMARY OF THE INVENTION

It is an object of the present invention to provide a muffler which can sufficiently resist a circumferential rotative force or moment applied to an outer box thereof for protection against relative rotation between the outer box and an exhaust pipe attached thereto.

To achieve the above object, there is provided in accordance with the present invention a muffler comprising an exhaust pipe, an outer box fitted over and attached to the exhaust pipe, and a connecting member of a noncircular cross section fixed to the exhaust pipe and interposed between the exhaust pipe and the outer box.

The above and further objects, details and advantages of the present invention will become apparent from the following detailed description of preferred embodiments thereof, when read in conjunction with the accompanying drawings.

DETAILED DESCRIPTION OF THE PREFERRED EMBODIMENTS

Figure 1:
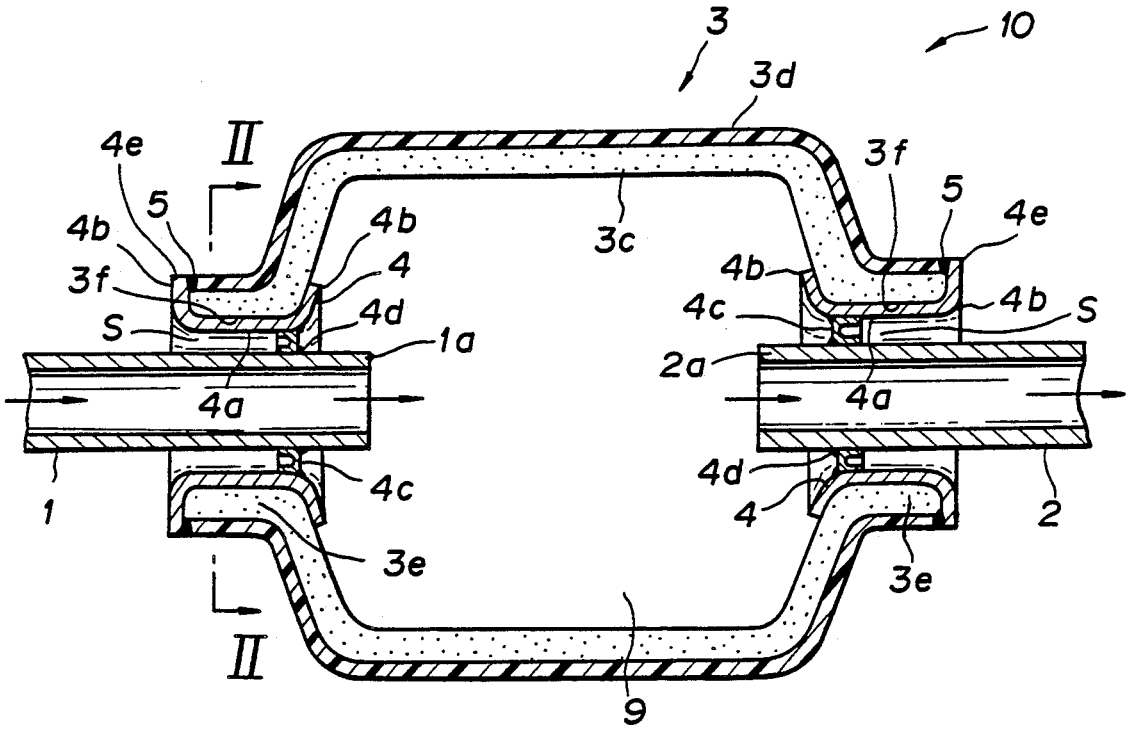
FIG. 1 is a vertical cross-sectional view of a muffler according to a first embodiment of the present invention.

FIG. 1 shows a muffler according to a first embodiment of the present invention, the muffler being generally designated by the reference numeral 10. The muffler 10 has an outer box 3 with an exhaust pipe 1 and a tail pipe 2 attached respectively to front and rear ends of the outer box 3. The outer box 3 has an expansion chamber 9 for introducing exhaust gases discharged from the exhaust pipe 1, the expansion chamber 9 being defined in the outer box 3 between the rear end 1*a* of the exhaust pipe 1 and the front end 2*a* of the tail pipe 2. Connecting members 4 are interposed between the outer box 3 and the exhaust pipe 1 and also between the outer box 3 and the tail pipe 2.

The outer box 3 is substantially tubular in shape with front and rear ends closed, and composed of a pair of upper and lower separate bodies 3*a*, 3*b* (see FIG. 2) of a formed sound insulation material which are joined to each other at their joint flanges 3*a*-1, 3*b*-1. Each of the separate bodies 3*a*, 3*b* has an inner porous layer 3*c* of good sound absorption and heat insulation capability, and an outer tight layer 3*d* made of resin or the like and having high rigidity and good sound insulation capability.

Each of the separate bodies 3*a*, 3*b* is formed as follows: Inorganic fibers such as long glass fibers, ceramic fibers, or the like, or long organic fibers such as polyester fibers or the like are cut off and mixed together into a wad, which is then pressed by rolls and needled into a mat. Thereafter, the mat is impregnated with a binder such as water glass. The mat is then placed in a mold of such a shape as to form the separate body, and then baked under pressure. The surface layer of the mat which is held against the high-temperature mold surface is hardened into the tight layer 3*d*, with the opposite surface layer of the mat serving as the porous layer 3*c*, thus forming the separate body 3*a* or 3*b*. In order to increase the thickness of the tight layer 3*d* for higher hardness, the surface layer of the mat may be impregnated with a solution of a thermosetting resin such as epoxy resin or the like, besides the water glass, before the mat is baked. Alternatively, after the mat has been baked in the mold, the mat may be coated with a thermoplastic resin and then formed to shape again.

Figure 2:
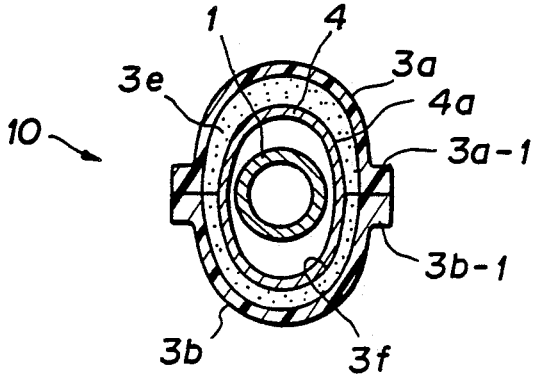
FIG. 2 is a cross-sectional view taken along line II—II of FIG. 1.

The tubular outer box 3 thus formed has smaller-diameter portions 3*e* on its front and rear ends, respectively, for attachment of the pipes 1, 2. As shown in FIG. 2, each of the smaller-diameter portions 3*e* is of a vertically elongate elliptical cross section in a plane normal to the longitudinal axis of the exhaust pipe 1. The elliptical cross section of the smaller-diameter portions 3*e* is substantially the same as the cross section of the connecting members 4.

Each of the connecting members 4 comprises a receiver 4*a* for receiving thereon an inner peripheral surface 3*f* of one of the smaller-diameter attachment portions 3*e* of the outer box 3, a pair of flanged retainers 4*b* disposed on front and rear ends of the receiver 4*a* and projecting radially outwardly from the receiver 4*a* for retaining the front and rear ends of the attachment portion 3*e*, and an annular support 4*c* for attaching the receiver 4*a* near an inner end thereof to the exhaust pipe 1 or the tail pipe 2. The receiver 4*a* extends along the longitudinal axis of the exhaust pipe 1.

The supports 4*c* have respective inner peripheral edges 4*d* welded to the exhaust and tail pipes 1, 2, respectively, and respective outer peripheral edges integrally joined to the receivers 4*a*, respectively. The attachment portions 3*e* of the outer box 3 are connected respectively to the receivers 4*a* of the connecting members 4 by means of an adhesive (not shown).

Thermally resistant, heat insulation seals 5 such as of silicone rubber are interposed between the outer ends of the attachment portions 3*e* of the outer box 3 and the outer retainers 4*b* of the connecting members 4 for increased sound insulation.

As illustrated in FIG. 2, each of the receivers 4*a* of the connecting members 4 is of a vertically elongate elliptical cross section which is substantially the same as the cross section of the attachment portions 3*e* of the outer box 3. Since the cross-sectional shapes of the attachment portions 3*e* and the receivers 4*a* are noncircular, the outer box 3 is effectively prevented from rotating circumferentially with respect to the receivers 4*a*. The outer box 3 is also prevented from rotating with respect to the exhaust pipe 1 and the tail pipe 2 because the receivers 4*a* are welded to the exhaust pipe 1 and the tail pipe 2.

With the connecting members 4 provided in the muffler 10, annular spaces S opening into the atmosphere are defined between inner peripheral surfaces of the receivers 4*a*, axially outer surfaces of the supports 4*c*, and outer peripheral surfaces of the exhaust and tail pipes 1, 2. These surfaces defining the spaces S serve as radiating surfaces for radiating the heat of the exhaust gases into the atmosphere. Therefore, a large amount of heat is prevented from being transmitted from the exhaust pipe 1 and the tail pipe 2 to the tight layers 3*d* which are relatively vulnerable to high temperatures. Accordingly, the outer tight layers 3*d* and hence the entire muffler 10 are of increased durability.

The heat radiation from the above surfaces is also effective to limit the heating to a high temperature of the seals 5 between the connecting members 4 and the outer box 3, so that the durability of the seals 5 is also increased. Therefore, the seals 5 may be made of a material which is less thermally resistant than conventional seals. The muffler 10 can be manufactured less costly and more efficiently.

The receivers 4*a* of the connecting members 4 are of a diameter larger than the outside diameter of the exhaust pipe 1. Since the diameter of the attachment portions 3*e* is not required to be considerably small, the attachment portions 3*e* can be formed with ease. Thus, the muffler 10 can be manufactured efficiently.

Figure 3:
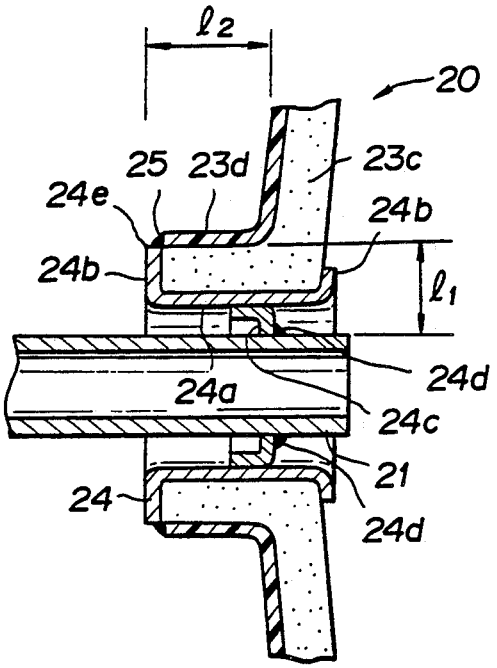
FIG. 3 is a fragmentary horizontal cross-sectional view of a muffler according to a second embodiment of the present invention.
Figure 4:
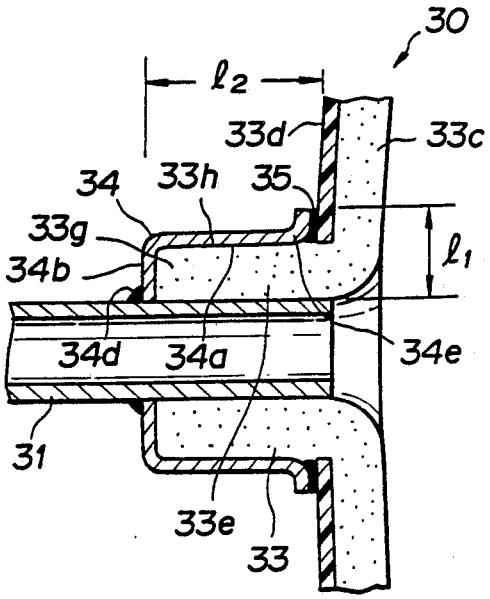
FIG. 4 is a fragmentary horizontal cross-sectional view of a muffler according to a third embodiment of the present invention.
Figure 5:
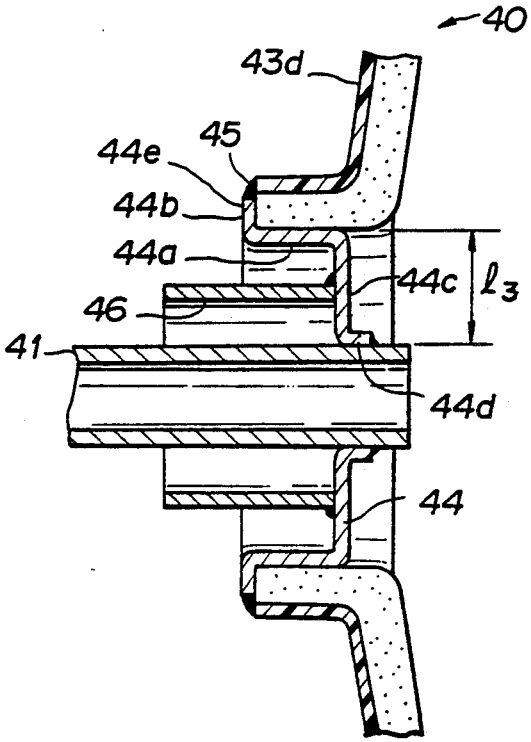
FIG. 5 is a fragmentary horizontal cross-sectional view of a muffler according to a fourth embodiment of the present invention.

FIGS. 3 through 5 show mufflers of other embodiments in which the receivers of the connecting members and the attachment portions of the outer box are of a vertically elongate elliptical cross section, as with the embodiment shown in FIG. 2, but may be of a circular cross section.

FIG. 3 illustrates a muffler 20 according to a second embodiment of the present invention. Those parts of the muffler 20 shown in FIG. 3 which are identical to those of the muffler 10 are denoted by reference numerals with the tens digit being 2 and the ones digit being identical to the reference numerals of the muffler 10, and will not be described in detail. In subsequent embodiments, the reference numerals identical to those of the first embodiment are employed except for different numerals in the tens digit.

In the muffler 20, an weld 24*d* between an exhaust pipe 21 and a connecting member 24 is positioned inwardly (i.e., with respect to the geometry of an outer box 23) of a joint 24*e* between the connecting member 24 and the outer box 23, and a receiver 24*a* and a retainer 24*b* which provide heat radiating surfaces are disposed in confronting relation to an exhaust pipe 21.

The distance $l_1$ in the radial direction of the exhaust pipe 21 between the joint 24*e* between a tight layer 23*d* of the outer box 23 and the connecting member 24, and the welded joint 24*d* between the connecting member 24 and the exhaust pipe 21 is about 15 mm. The distance $l_2$ between the joints 24*d*, 24*e* in the axial direction of the exhaust pipe 21 is approximately 40 mm.

FIG. 4 shows a muffler 30 according to a third embodiment of the present invention. In the muffler 30, an attachment portion 33*e* of an outer box 33 comprises a porous layer 33*c* of a heat insulation material only, and a connecting member 34 is disposed in surrounding relation to a front end 33*g* and an outer periphery 33*h* of the attachment portion 33*e*. The connecting member 34 has a rear end 34*e* joined to a tight layer 33*d* of the outer box 33 through a seal 35. A welded joint 34*d* between the connecting member 34 and an exhaust pipe 31 is positioned outwardly of the joint (at the rear end 34*e*) between the connecting member 34 and the outer box 33 with respect to the geometry of the outer box 33. A receiver 34*a* and a retainer 34*b* which provide heat radiating surfaces are exposed outwardly.

The distance $I_1$ in the radial direction of the exhaust pipe 31 between the joint 34*e* between the tight layer 33*d* of the outer box 33 and the connecting member 34, and the welded joint 34*d* between the connecting member 34 and the exhaust pipe 31 is about 15 mm. The distance $l_2$ between the joints 34*d*, 34*e* in the axial direction of the exhaust pipe 31 is approximately 40 mm.

FIG. 5 shows a muffler 40 in accordance with a fourth embodiment of the present invention. In the muffler 40, the distance $l_3$ between an exhaust pipe 41 and a heat radiating surface provided by the back of a receiver 44*a* of a connecting member 44 is slightly larger than the corresponding distance in FIG. 3. A tubular heat radiating fin 46 is joined to a support 44*c* of the connecting member 44.

Figure 6:
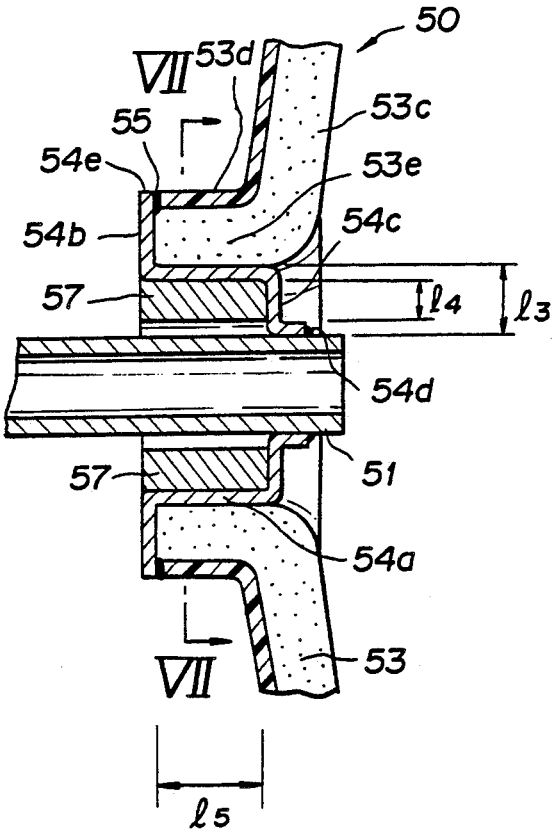
FIG. 6 is a fragmentary cross-sectional view of a muffler according to a fifth embodiment of the present invention.
Figure 7:
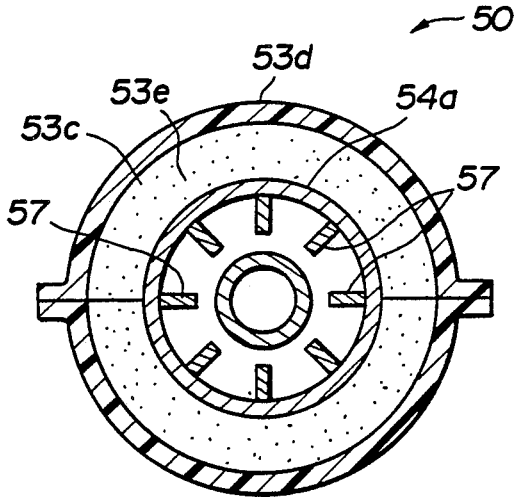
FIG. 7 is a cross-sectional view taken along line VI—VI of FIG. 6.

FIGS. 6 and 7 illustrate a muffler 50 according to a fifth embodiment of the present invention. As shown in FIG. 7, a receiver 54*a* of a connecting member 54 and an attachment portion 53*e* of an outer box 53 which is supported on the receiver 54*a* are circular in cross section. A plurality of circumferentially equally spaced heat radiating fins 57 are mounted on a heat radiating surface provided by the back or raidially inner surfadce of the receiver 54*a* and project radially inwardly toward an exhaust pipe 51. The distance $l_3$ between the heat radiating surface and the exhaust pipe 51 is about 10 mm, whereas the distance $l_4$ by which the fins 57 project is about 5 mm that is about half the distance $l_3$. The outer box 53 has a volume of about 1.5 liters, and the exhaust pipe 51 has a diameter of about 38.1 mm.

Figure 8:
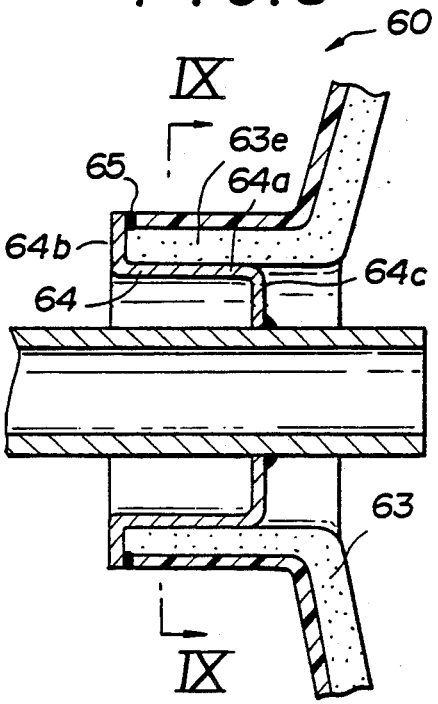
FIG. 8 is a fragmentary cross-sectional view of a muffler according to a sixth embodiment of the present invention.
Figure 9:
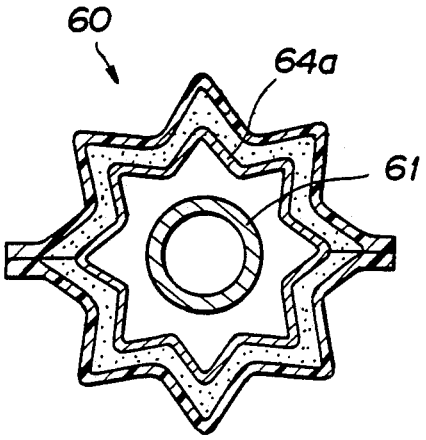
FIG. 9 is a cross-sectional view taken along line IX—IX of FIG. 8.

A muffler 60 according to a sixth embodiment of the present invention is shown in FIGS. 8 and 9. The muffler 60 includes a connecting member 64 having a receiver 64*a* of a polygonal cross section such as a star-shaped or corrugated cross section to provide a large heat radiating surface for higher heat radiating efficiency. An attachment portion 63*e* of an outer box 63 also has a star-shaped or corrugated cross section complementary to that of the receiver 64*a* to effectively prevent the outer box 63 from being circumferentially rotated with respect to the connecting member 64.

Figure 10:
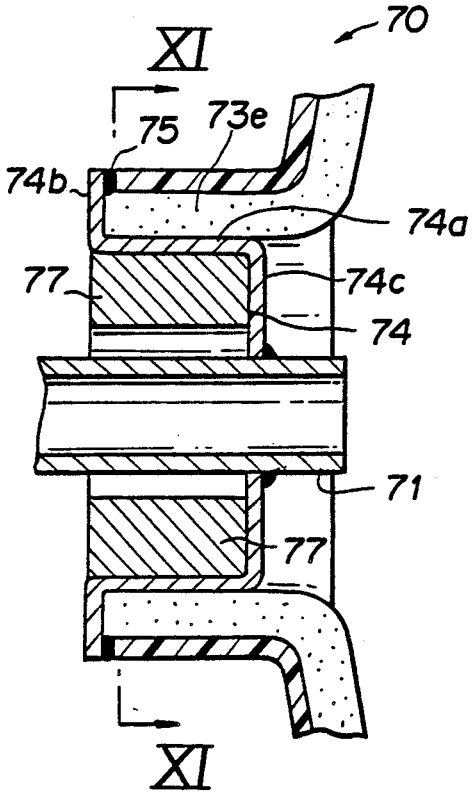
FIG. 10 is a fragmentary cross-sectional view of a muffler according to a seventh embodiment of the present invention.
Figure 11:
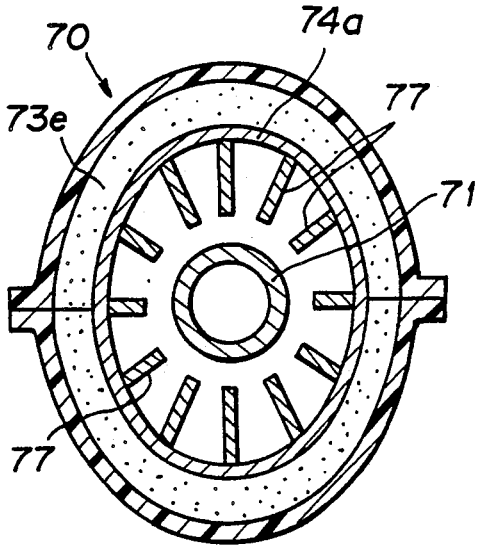
FIG. 11 is a cross-sectional view taken along line XI—XI of FIG. 10.

FIGS. 10 and 11 show a muffler 70 according to a seventh embodiment of the present invention. As shown in FIG. 11, the muffler 70 includes a connecting member 74 having a receiver 74*a* of an elliptical cross section and an outer box 73 having an attachment portion 73*e* of a complementary elliptical cross section. A plurality of circumferentially equally spaced heat radiating fins 77 are mounted on a heat radiating surface provided by the back or radially inner surface of the receiver 74*e* and project radially inwardly toward an exhaust pipe 71.

Since the cross sections of the attachment portion 73*e* and the receiver 74*a* of the muffler 70 are of complementary noncircular shapes, the outer box 73 is effectively prevented from being rotated with respect to the receiver 74*a*.

Figure 12:
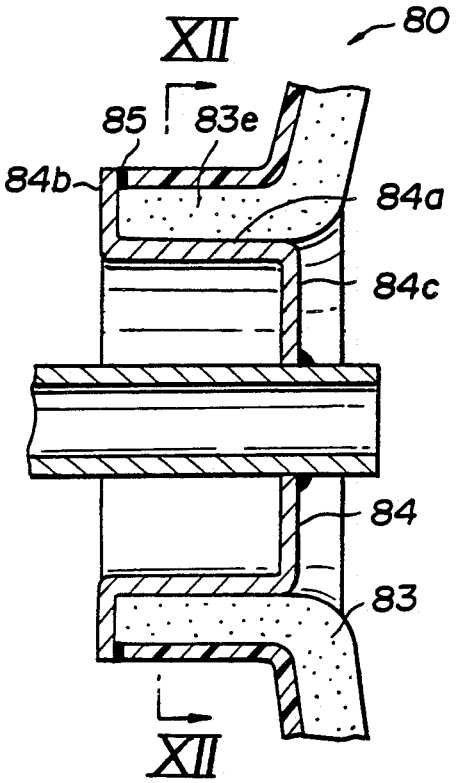
FIG. 12 is a fragmentary cross-sectional view of a muffler according to an eighth embodiment of the present invention.
Figure 13:
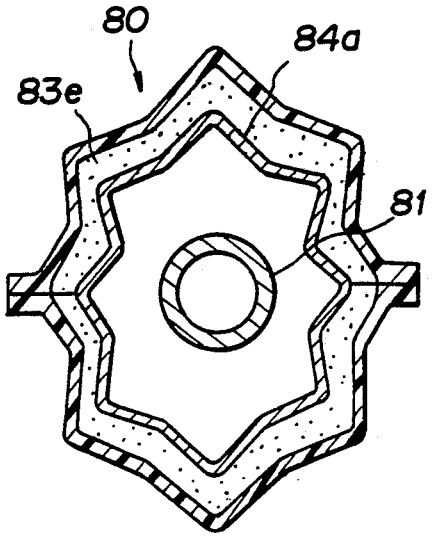
FIG. 13 is a cross-sectional view taken along line XIII—XIII of FIG. 12.

According to an eighth embodiment of the present invention shown in FIGS. 12 and 13, a muffler 80 includes a connecting member 84 having a receiver 84*a* of a vertically elongate star-shaped or corrugated cross section to provide an increased heat radiating surface for greater heat radiation efficiency. The muffler 80 also includes an outer box 83 having an attachment portion 83*e* of a vertically elongate star-shaped or corrugated cross section which is complementary to the cross section of the receiver 84*a* to prevent the outer box 83 from being rotated with respect to the connecting member 84.

The principles of the present invention are applicable to mufflers of various types including a muffler having a plurality of sound deadening chambers, and a muffler having a baffle plate in a sound deadening chamber, for example.

Although there have been described what are at present considered to be the preferred embodiments of the present invention, it will be understood that the invention may be embodied in other specific forms without departing from the essential characteristics thereof. The present embodiments are therefore to be considered in all aspects as illustrative, and not restrictive. The scope of the invention is indicated by the appended claims rather than by the foregoing description.

We claim:

1. A muffler comprising:

an outer box forming an exhaust gas expansion chamber;

an exhaust pipe connected at one end of said exhaust pipe to said outer box for feeding exhaust gas into said box;

a discharge pipe connected at one end of said discharge pipe to said outer box for discharging expanded exhaust from said box; and a connecting member of a noncircular cross section having means for radiating heat and fixed to said one end of at least one of said exhaust pipe and said discharge pipe, where said one end of said at least one of said exhaust pipe and said discharge pipe is connected to said outer box, said connecting member being interposed between said one end and said outer box, said outer box having a hardened, tight resin outer layer and a porous inner heat insulation layer.

2. A muffler according to claim 1, wherein said cross section of said connecting member is substantially elliptical.

3. A muffler according to claim 1, wherein said cross section of said connecting member is substantially polygonal.

4. A muffler according to claim 1, wherein said connecting member has a noncircular cross section in a plane normal to a longitudinal axis of said exhaust pipe, said outer box has an attachment attached to said connecting member and said attachment portion has a noncircular cross section complementary to the cross section of said connecting member in a plane normal to the longitudinal axis of said exhaust pipe.

5. A muffler comprising:

an outer box forming an exhaust gas expansion chamber;

an exhaust pipe connected at one end of said exhaust pipe to said outer box for feeding exhaust gas into said box;

a discharge pipe connected at one end of said discharge pipe to said outer box for discharging expanded exhaust from said box; and a connecting member of a noncircular cross section fixed to said one end of at least one of said exhaust pipe and said discharge pipe, where said one end of said at least one of said exhaust pipe and said discharge pipe is connected to said outer box, said connecting member being interposed between said one end and said outer box; said outer box having an outer layer and an inner heat insulation layer and said connecting member having a heat radiating surface for radiating heat from said connecting member, said heat radiating surface being disposed between said exhaust pipe and a joint by which said connecting member is joined to said outer box.

6. A muffler according to claim 5, wherein said outer layer comprises a tight layer of resin.

7. A muffler according to claim 5, wherein said connecting member comprises a receiver extending in a longitudinal direction of said exhaust pipe and supporting said outer box, and a support attaching said receiver to said exhaust pipe in spaced relation thereto.

8. A muffler according to claim 7, wherein said heat radiating surface comprises an outer surface of said receiver of said connecting member.

9. A muffler according to claim 8, further including a plurality of heat radiating fins mounted on said heat radiating surface.

10. A muffler according to claim 8, further including a heat radiating fin mounted on said support of said connecting member.

11. A muffler comprising:

an outer box, said outer box having an outer layer and an inner heat insulating layer and forming an exhaust gas expansion chamber;

an exhaust pipe connected at one end of said exhaust pipe to said outer box for feeding exhaust gas into said expansion chamber;

a discharge pipe connected at one end of said discharge pipe to said outer box for discharging expanded exhaust gas from said expansion chamber;

a connecting member fixed to said one end of at least one of said exhaust pipe and said discharge pipe, where said one end of said at least one of said exhaust pipe and said discharge pipe is connected to said outer box, said connecting member being interposed between said one end and said outer box, said connecting member having a heat radiating surface for radiating heat from said connecting member, said heat radiating surface being disposed between said one end of at least one of said exhaust pipe and said discharge pipe and a joint by which said connecting member is joined to said outer box.

12. A muffler according to claim 11, wherein said outer layer comprises a tight layer of resin.

* * * * *